US008579409B2

(12) United States Patent
Matsuura

(10) Patent No.: US 8,579,409 B2
(45) Date of Patent: Nov. 12, 2013

(54) INKJET RECORDING APPARATUS

(75) Inventor: Masaaki Matsuura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 661 days.

(21) Appl. No.: 12/170,018

(22) Filed: Jul. 9, 2008

(65) Prior Publication Data

US 2009/0015628 A1 Jan. 15, 2009

(30) Foreign Application Priority Data

Jul. 11, 2007 (JP) ..... 2007-181724

(51) Int. Cl.
*B41J 2/165* (2006.01)

(52) U.S. Cl.
USPC ..... 347/29

(58) Field of Classification Search
None
See application file for complete search history.

(56) References Cited

U.S. PATENT DOCUMENTS 6,913,340 B2 * 7/2005 Tanaka et al. ..... 347/29

FOREIGN PATENT DOCUMENTS

| | | |
|---|---|---|
| JP | 7-276658 | 10/1995 |
| JP | 10-128987 | 5/1998 |
| JP | 2005-169713 | 6/2005 |

* cited by examiner

*Primary Examiner* — Matthew Luu
*Assistant Examiner* — Alejandro Valencia
(74) *Attorney, Agent, or Firm* — Canon USA Inc IP Division

(57) ABSTRACT

An inkjet recording apparatus that enables a cap and a recording head stuck together to be easily separated is provided. The inkjet recording apparatus has a rotatably supported cap holder retaining a cap for covering ejection orifices in a recording head, and an actuator that moves the cap holder to bring the cap into contact with and away from the recording head. A first contact portion configured to seal an ejection orifice row and a second contact portion connected to the outer surface of the first contact portion and configured to be pressed against the ejection orifice surface are provided on a surface of the cap to be brought into contact with the ejection orifice surface. The actuator acts on the cap holder at a position to the second contact portion side of the rotational axis of the cap holder.

7 Claims, 11 Drawing Sheets

INKJET RECORDING APPARATUS

BACKGROUND OF THE INVENTION

1. Field of the Invention

The present invention relates to an inkjet recording apparatus that performs recording by ejecting ink from a recording head onto a recording medium. More specifically, the present invention relates to an inkjet recording apparatus that has a cap for covering ejection orifices in a recording head.

2. Description of the Related Art

An inkjet recording apparatus performs recording by selectively ejecting ink from a plurality of ejection orifices in accordance with image information. Such an inkjet recording apparatus uses a cap for covering ejection orifices to protect the recording head and to prevent ink from drying. A typical cap is made of an elastomer, such as rubber, to ensure sealing performance.

If a cap is kept in contact with an ejection orifice surface of a recording head for a certain period of time, the cap may stick to the recording head depending on the materials of the cap and the ejection orifice surface or storage condition after shipment. When the recording apparatus is turned on when the cap and the recording head stick together, they may not be easily separated, which may cause malfunction.

Japanese Patent Laid-Open Nos. 7-276658 and 2005-169713 each disclose an inkjet recording apparatus that enables a cap to be easily removed from an ejection orifice surface of a recording head, by separating the contact surfaces of the cap and the ejection orifice surface from one end, and subsequently separating the remaining portion of the contact surfaces. Japanese Patent Laid-Open No. 10-128987 discloses an inkjet recording apparatus in which an anti-stick liquid is applied to one of the contact surfaces of the recording head and the cap.

As the quality of images produced by inkjet recording apparatuses these days improves, the size of ejection orifices in recording heads further decreases and the density of the ejection orifices becomes higher. This requires improvement in sealing performance of caps for covering ejection orifice surfaces of recording heads. To improve sealing performance of caps, unnecessary deformation of the caps in a capped state needs to be eliminated. However, if caps are more tightly brought into contact with ejection orifice surfaces of recording heads, the caps more strongly stick thereto. This results in a problem in that a large force is required to remove the caps from the ejection orifice surfaces of the recording heads.

SUMMARY OF THE INVENTION

The present invention provides an inkjet recording apparatus that enables a cap and a recording head stuck together to be easily separated with a small force.

According to an aspect of the present invention, an inkjet recording apparatus that performs recording by ejecting ink from a recording head onto a recording medium includes a cap having a first contact portion configured to seal ejection orifices by being pressed against an ejection orifice surface of the recording head; a second contact portion connected to an outer surface of the first contact portion, the second contact portion being configured to be pressed against the ejection orifice surface; a cap holder retaining the cap, the cap holder being rotatably supported by a base; and a moving mechanism configured to move the cap holder to bring the first contact portion into contact with and away from the ejection orifice surface. The moving mechanism acts on the cap holder at a position to the second contact portion side of a rotational axis of the cap holder.

Further features of the present invention will become apparent from the following description of exemplary embodiments with reference to the attached drawings.

DESCRIPTION OF THE EMBODIMENTS

First Exemplary Embodiment

Figure 1:
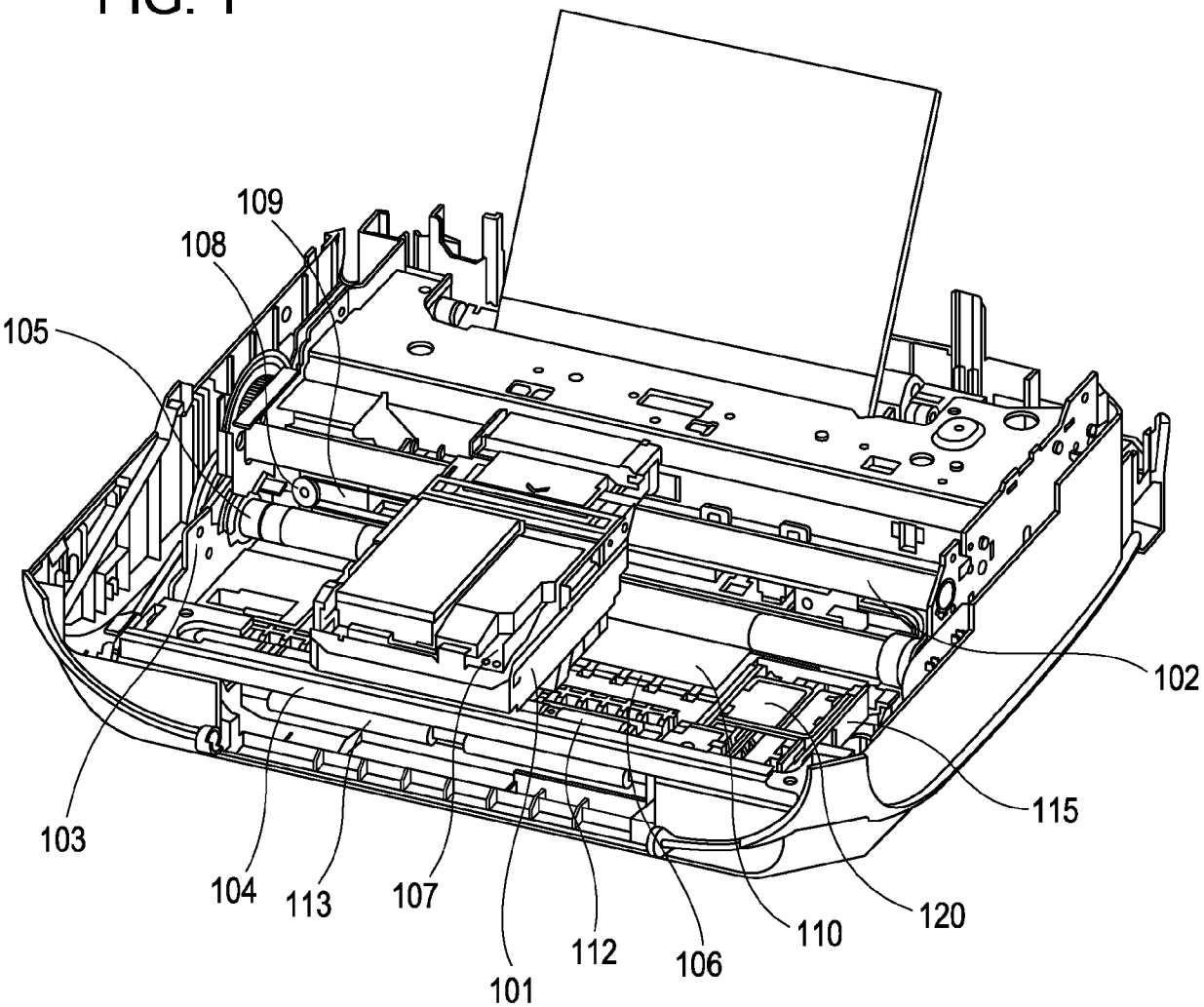
FIG. 1 is a perspective view of an inkjet recording apparatus suitable for embodying the present invention.

Embodiments of the present invention will now be described with reference to the accompanying drawings. Like reference numerals refer to like parts or corresponding parts throughout the various views. FIG. 1 is a perspective view of an inkjet recording apparatus suitable for embodying the present invention. In FIG. 1, a carriage 101 carries a recording head 107 and is supported in a manner capable of reciprocating along a guide shaft 102 and a guide rail 104. The carriage 101 is driven by a driving force from a carriage motor 108 transmitted through a belt 109. A recording medium 110 is conveyed through the nip of a conveying roller 105 and a pinch roller (not shown) to a platen 106, where the recording medium 110 faces the recording head 107. The guide shaft 102 and the conveying roller 105 are supported by a chassis 103. An eject roller 113 is provided downstream of the platen 106 with respect to the conveying direction of the recording medium 110. An auxiliary roller 112 is pressed against the eject roller 113. The recording head 107 performs recording onto the recording medium 110 being conveyed on the platen 106 by the conveying roller 105 and the eject roller 113.

During recording, the carriage 101 moves at a constant speed after it begins to move and accelerate. At this time, the recording head 107 ejects ink from the ejection orifices onto the recording medium 110 facing the recording head 107 to form an image. When recording of one line is completed, the carriage 101 decelerates to stop. When the carriage 101 begins to decelerate, the conveying roller 105 and the eject roller 113 rotate to convey the recording medium 110 by a predetermined amount for recording of the next line. The carriage 101 then starts to move in the reverse direction. While the carriage 101 moves at a constant speed after acceleration, the recording medium 110 is not conveyed. The recording of the next line is performed by driving the recording head 107 while the carriage 101 is moving. Recording on the entire recording medium 110 is performed by alternately performing driving of the recording head 107 during movement of the carriage 101 and conveyance of the recording medium 110 at a predetermined pitch. The recording medium 110 after going through recording is ejected from the main body of the apparatus by the eject roller 113.

Figure 2:
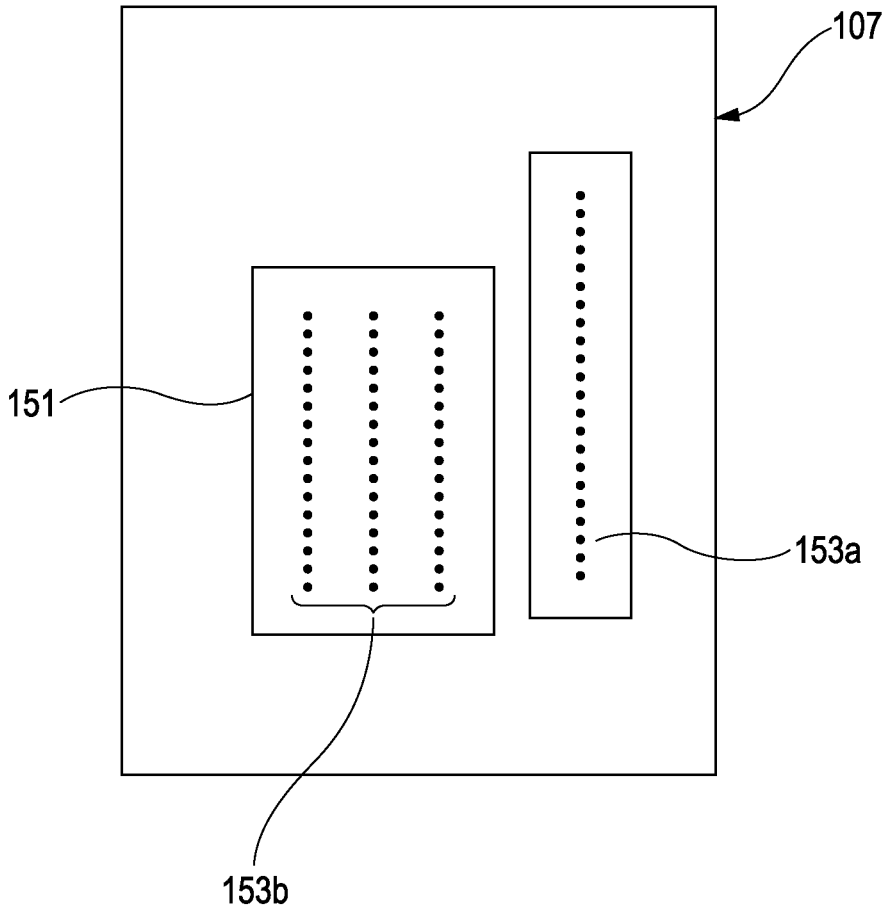
FIG. 2 shows an arrangement of ejection orifices in an ejection orifice surface of a recording head.

FIG. 2 shows an arrangement of ejection orifices in an ejection orifice surface of a recording head. An ejection orifice surface 151 of the recording head 107 has a plurality of ejection orifices provided in a predetermined arrangement. The ejection orifice surface 151 according to the present embodiment has a black-ink ejection orifice row 153*a* through which black ink is ejected and color-ink ejection orifice rows 153*b* through which color ink is ejected. The color-ink ejection orifice rows 153*b* include, for example, cyan-ink, magenta-ink, and yellow-ink ejection orifice rows.

Referring back to FIG. 1, a recovery unit 115 for preventing the recording head 107 from being clogged and for maintaining and restoring ink ejecting performance is provided at a predetermined position where recording is not performed. The recovery unit 115 has a cap for covering the ejection orifices in the recording head 107, a wiper for cleaning the ejection orifice surface, and a pump connected to the cap for vacuuming ink. The cap protects the ejection orifice surface and prevents ink from drying. The wiper wipes ink and dust deposited around the ejection orifices. The pump, usually a tube pump that creates negative pressure by pressing a tube, vacuums unwanted ink in the ejection orifices and the cap.

Figure 3:
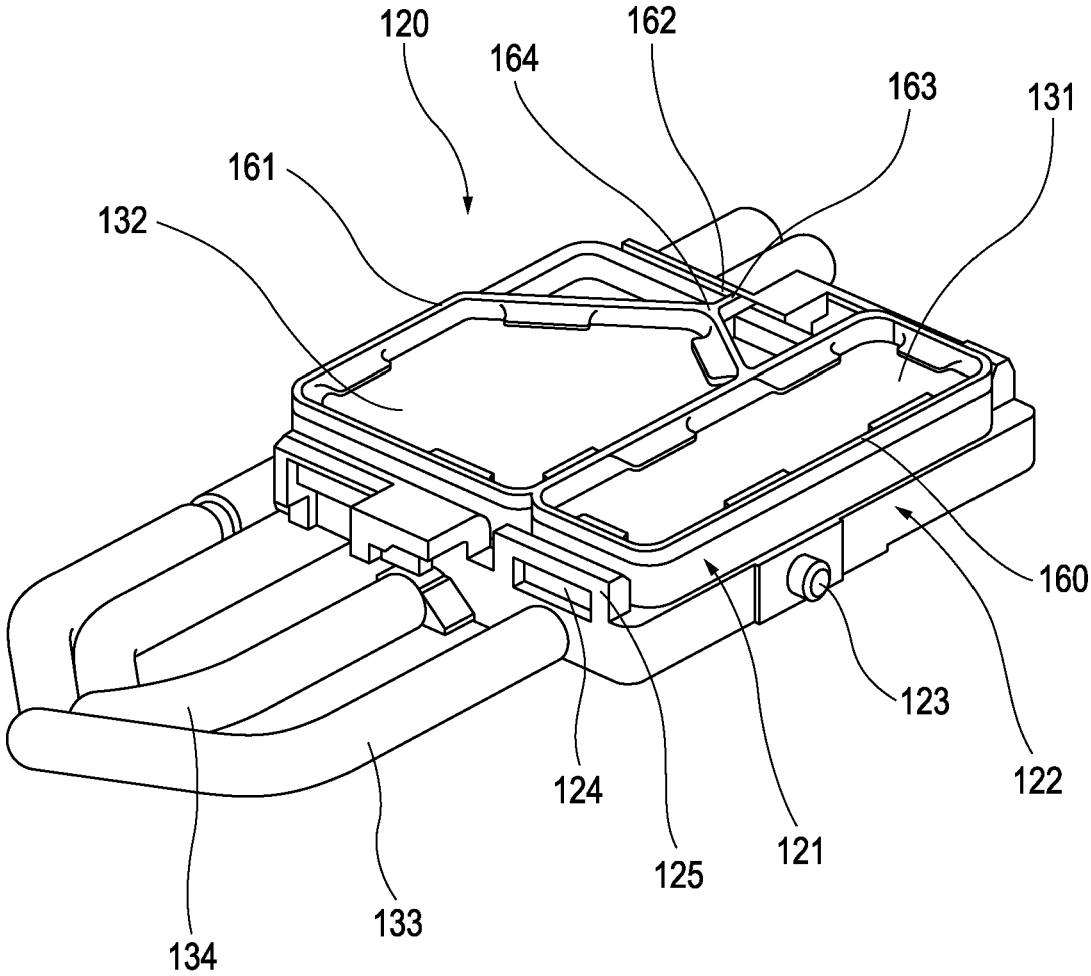
FIG. 3 is a perspective view of a cap unit of an inkjet recording apparatus according to a first embodiment.
Figure 4:
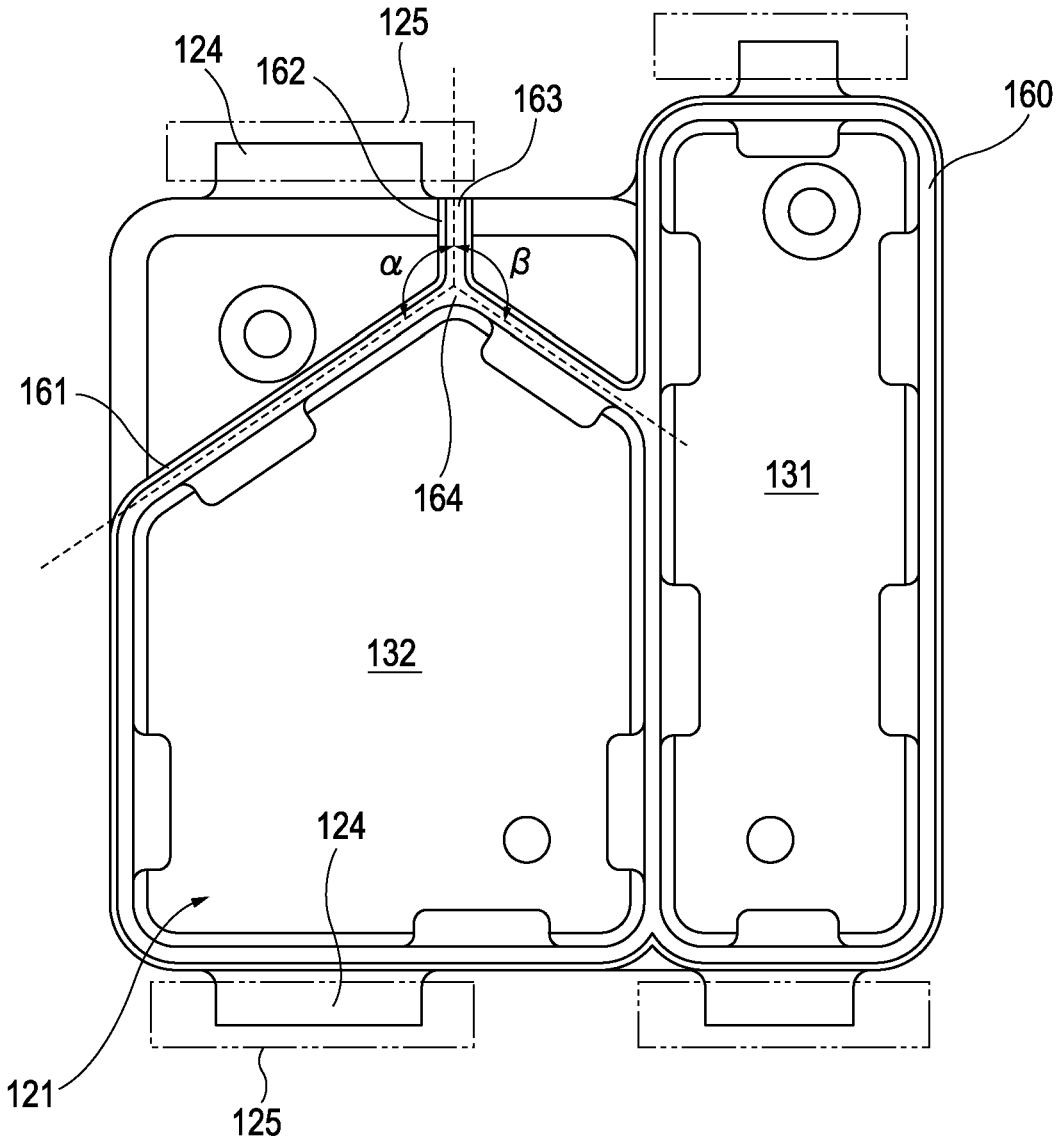
FIG. 4 is a plan view of the cap unit.
Figure 5:
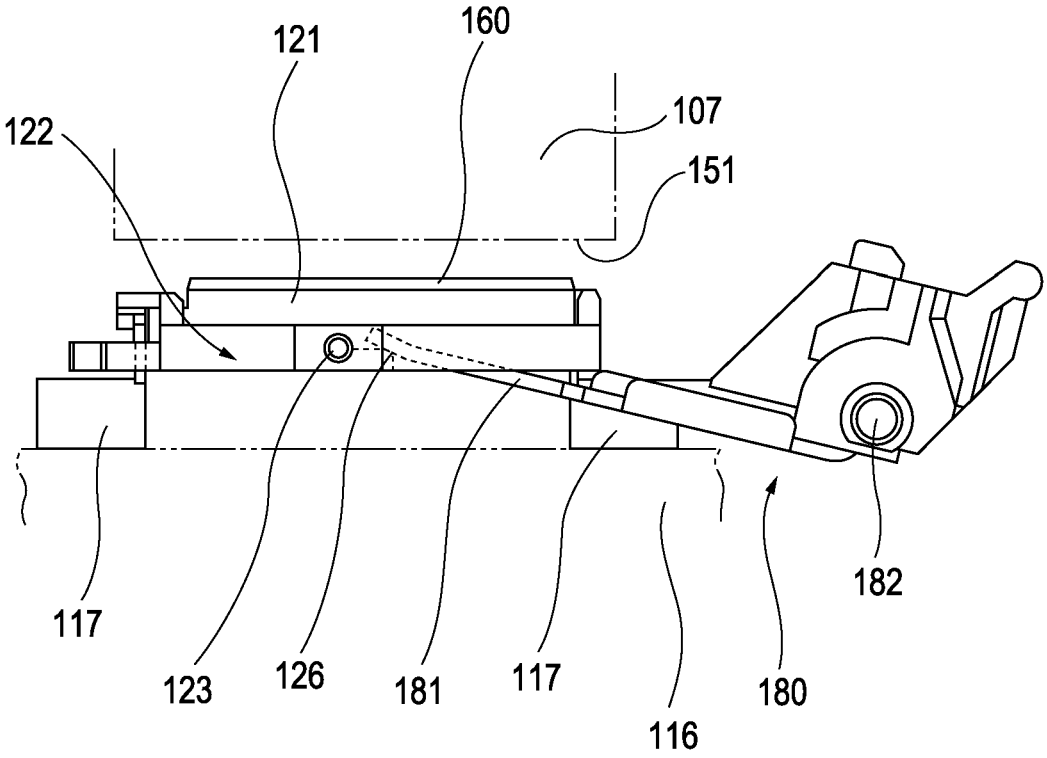
FIG. 5 is a side view of the cap unit.

FIG. 3 is a perspective view of a cap unit 120 of the inkjet recording apparatus according to the first embodiment. FIG. 4 is a plan view of the cap unit 120. FIG. 5 is a side view of the cap unit 120. The recovery unit 115 has the cap unit 120 for covering the ejection orifices by bringing a cap 121 into contact with the ejection orifice surface 151. The cap 121 has a black contact portion 160 configured to seal the black-ink ejection orifice row 153*a* by being pressed against the ejection orifice surface 151 of the recording head 107, a first contact portion 161 configured to seal the color-ink ejection orifice rows 153*b*, and a second contact portion 162 connected to the outer surface of the first contact portion 161, configured to be pressed against the ejection orifice surface 151. The second contact portion extends perpendicular to the rotational axis of a cap holder 122.

The second contact portion 162 connects to the outer surface of the first contact portion 161 at one end, which is denoted by a connecting portion 164, and ends at the other end, which is denoted by an end portion 163. The first contact portion 161 and the second contact portion 162 form obtuse angles $\alpha$ and $\beta$ on the other side of the area sealing the color-ink ejection orifice rows 153*b*.

The cap 121 has a plurality of engaging portions 124 that project from the side surfaces thereof. The cap holder 122 has cap retainer portions 125 at positions corresponding to the engaging portions 124. By engaging the engaging portions 124 of the cap 121 with the cap retainer portions 125 of the cap holder, the cap 121 is positioned on and fitted to the cap holder 122. The second contact portion 162 is provided in the vicinity of one of the cap retainer portions 125 of the cap holder 122, i.e., in the vicinity of one of the engaging portions 124 of the cap 121. The cap holder 122 has a shaft 123 that is rotatably supported by a base 116 of the recovery unit 115. A spring 117 urges the cap holder 122 to bring the cap 121 into contact with the ejection orifice surface 151. The cap 121 contains an ink absorber 131 facing the black-ink ejection orifice row 153*a* and an ink absorber 132 facing the color-ink ejection orifice rows 153*b*. A black-ink tube 133 for vacuuming black ink and a color-ink tube 134 for vacuuming color ink are each connected to the cap holder 122 at one end and to a tube pump at the other end.

An actuator 180 (shown in FIG. 5) moves the cap holder 122 to bring the cap 121 into contact with and away from the ejection orifice surface 151 of the recording head 107. A point of application 126 is located between the shaft 123, which serves as the rotational axis of the cap holder 122, and the end portion 163 of the second contact portion 162. An end of a lever 181 of the actuator 180 is in contact with the point of application 126. When an actuating shaft 182 of the actuator 180 is driven to rotate the lever 181 counterclockwise in FIG. 5, the cap holder 122 is brought away from the ejection orifice surface 151 (downward in FIG. 5), through the point of application 126. At this time, a clockwise moment about the shaft 123, i.e., a moment that brings the second contact portion 162 away from the ejection orifice surface 151 from the end portion 163, acts on the cap holder 122. Thus, the actuator 180 applies a force to the portion between the shaft 123 of the cap holder 122 and the end portion 163 of the second contact portion 162 to bring the cap 121 away from the ejection orifice surface 151, overcoming the resistance of the spring 117. The point of application 126 may be provided at a position relatively close to the shaft 123 as shown in FIG. 5, so that a force of the actuator 180 acts on a position close to the shaft 123.

Figure 6A:
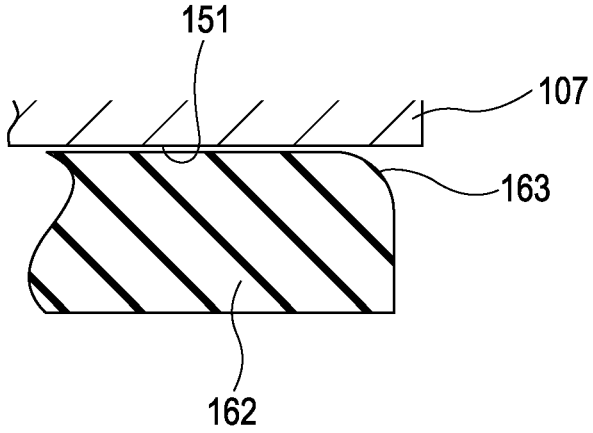
FIGS. 6A to 6C are side views of a second contact portion in contact with the ejection orifice surface.
Figure 6B:
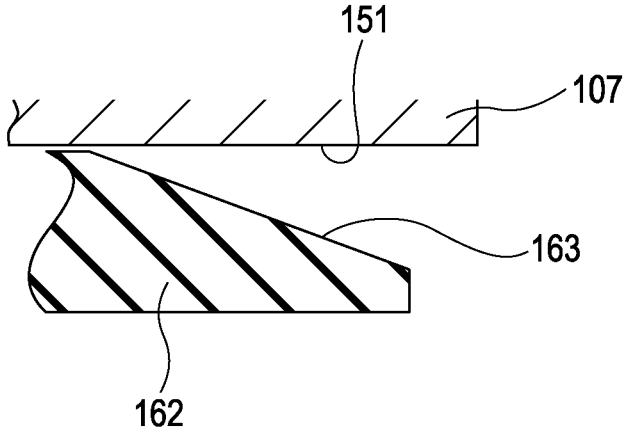
Figure 6C:
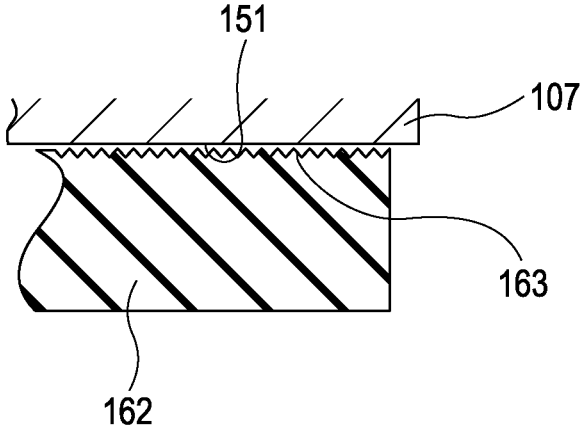

FIGS. 6A to 6C are side views of the second contact portion 162 in contact with the ejection orifice surface 151. It is desirable that the second contact portion 162 have a shape that enables the cap 121 and the ejection orifice surface 151 to be easily separated. As shown in FIG. 6A, the second contact portion 162 may be rounded at the end portion 163. Alternatively, as shown in FIG. 6B, the second contact portion 162 may decline from the connecting portion 164 toward the end portion 163. Further alternatively, as shown in FIG. 6C, the second contact portion 162 may have a larger surface roughness than the first contact portion 161 to reduce the area in contact with the ejection orifice surface 151.

Figure 7A:
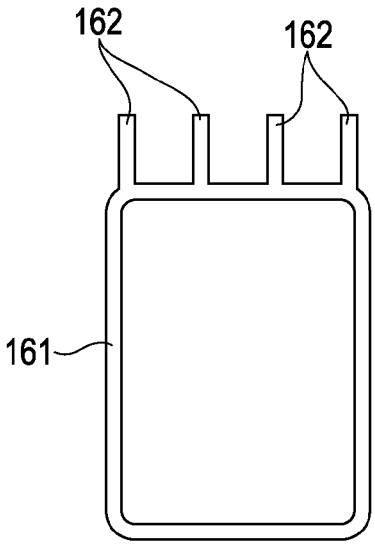
FIGS. 7A to 7D are plan views of a first contact portion and the second contact portion(s).
Figure 7B:
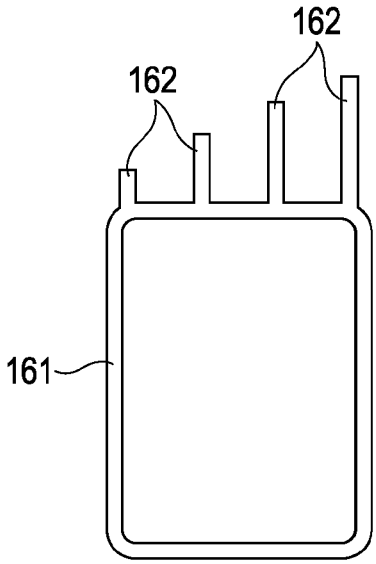
Figure 7C:
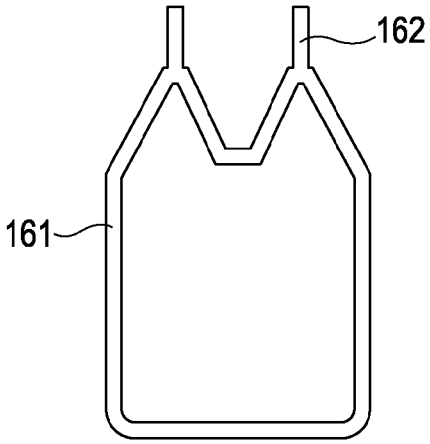
Figure 7D:
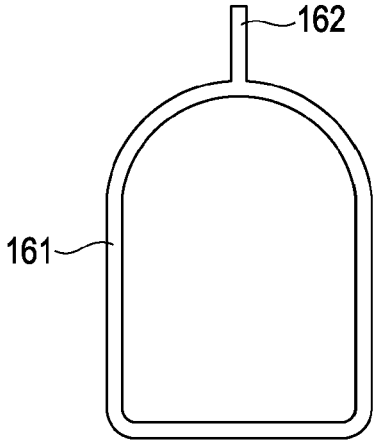

FIGS. 7A to 7D are plan views of the first contact portion 161 and the second contact portion(s) 162. As shown in FIG. 7A, a plurality of the second contact portions 162 that extend perpendicular to the rotational axis of the cap holder 122 may be provided on the outer surface of the first contact portion 161. As shown in FIG. 7B, the second contact portions 162 may have different lengths. Alternatively, as shown in FIG. 7C, the first contact portion 161 may have a plurality of chevron-shaped portions. Alternatively, as shown in FIG. 7D, the first contact portion 161 may have an arch-shaped portion.

Second Exemplary Embodiment

Figure 8A:
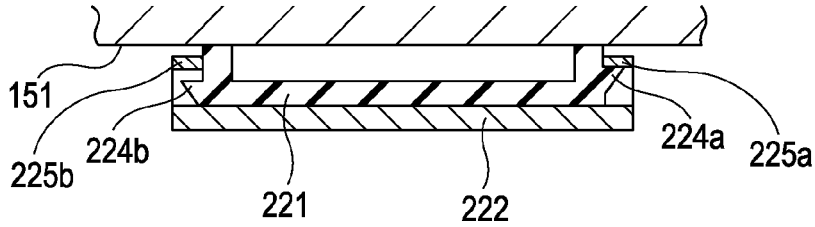
FIGS. 8A to 8C are side views of a cap unit according to a second embodiment.
Figure 8B:
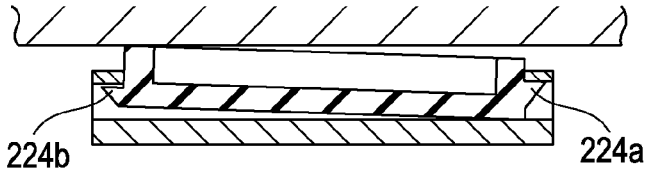
Figure 8C:
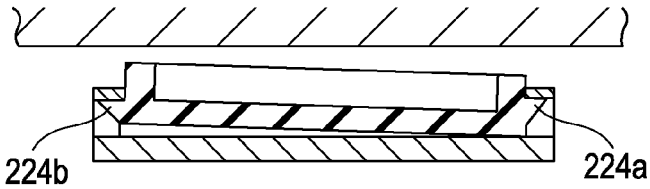

FIGS. 8A to 8C are side views of a cap unit according to a second embodiment, wherein FIG. 8A shows a state in which a cap 221 is in contact with the ejection orifice surface 151, FIG. 8B shows a state in which the cap 221 begins to be separated from the ejection orifice surface 151, and FIG. 8C shows a state in which the cap 221 has been removed from the ejection orifice surface 151. As shown in FIGS. 8A to 8C, the cap 221 has a first engaging portion 224*a* and a second engaging portion 224*b* that project from the side surfaces thereof. The first engaging portion 224*a* is provided at a position corresponding to the second contact portion 160. In the capped state, the top surface of the first engaging portion 224*a* is closer to the ejection orifice surface 151 than the top surface of the second engaging portion 224*b*. A cap holder 222 has a first retainer portion 225*a* and a second retainer portion 225*b* engageable with the engaging portions 224*a* and 224*b*, respectively. When the above-described actuator moves the cap holder 222 away from the ejection orifice surface 151, the first retainer portion 225*a* comes into contact with the first engaging portion 224*a* before the second retainer portion 225*b* comes into contact with the second engaging portion 224*b*. This structure allows the cap 221 to be removed from the ejection orifice surface 151 from the second contact portion 162 side.

Third Exemplary Embodiment

Figure 9:
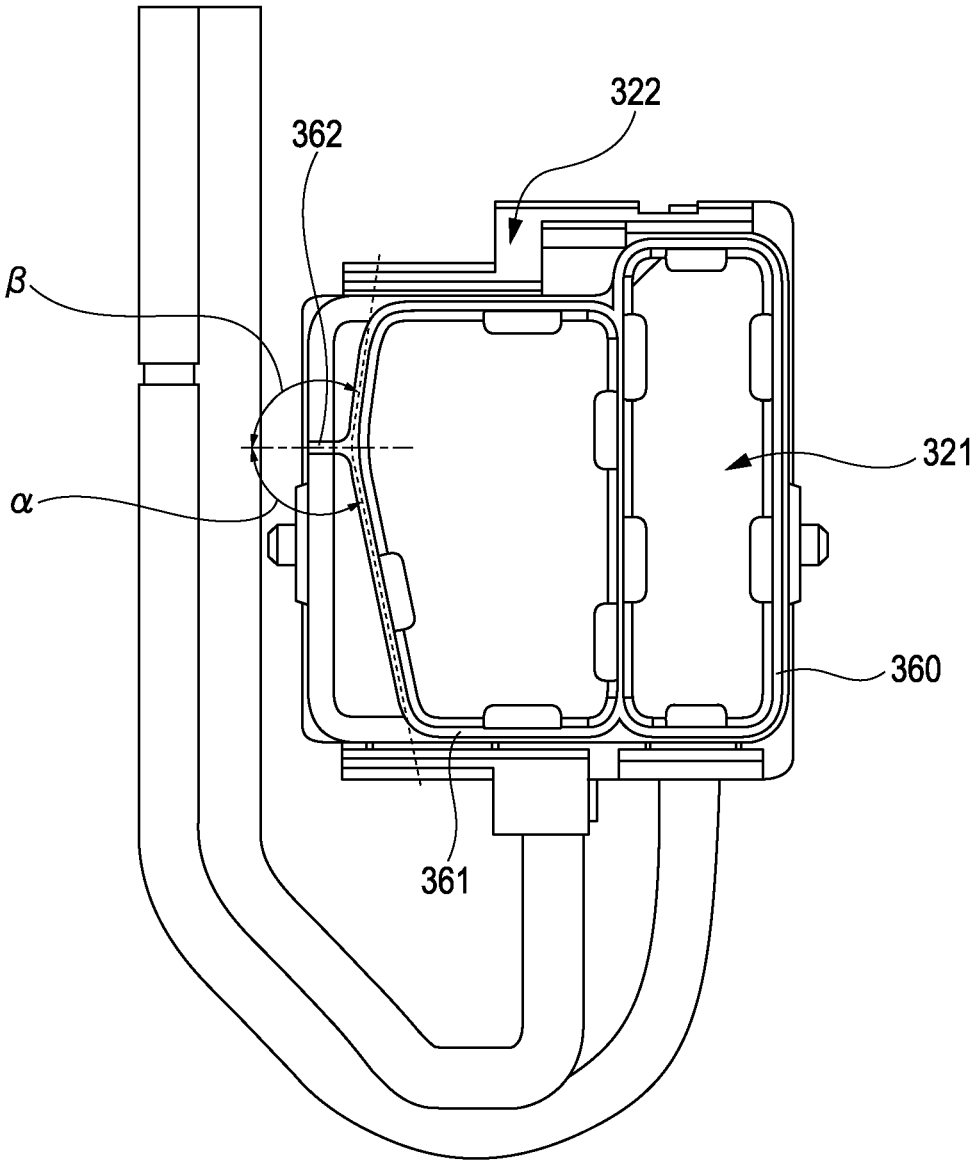
FIG. 9 is a plan view of a cap unit according to a third embodiment.

FIG. 9 is a plan view of a cap unit according to a third embodiment. The present embodiment is characterized by a second contact portion arranged parallel to the moving direction of the carriage. In FIG. 9, a cap 321 is provided to cover the ejection orifices by being brought into contact with the ejection orifice surface 151 of the recording head 107. A cap holder 322 retains the cap 321. The cap 321 has a black contact portion 360 configured to seal the black-ink ejection orifice row 153*a* by being pressed against an ejection orifice surface 151, a first contact portion 361 configured to seal the color-ink ejection orifice rows 153*b*, and a second contact portion 362 connected to the outer surface of the first contact portion 361, configured to be pressed against the ejection orifice surface 151. The second contact portion 362 is arranged parallel to the moving direction of the carriage 101 that reciprocates while carrying the recording head 107, as described above.

The second contact portion 362 connects to the outer surface of the first contact portion 361 at one end, and ends at the other end. The first contact portion 361 and the second contact portion 362 form obtuse angles $\alpha$ and $\beta$ on the other side of the area sealing the color-ink ejection orifice rows 153*b*. It is desirable that the second contact portion 362 have a shape that allows the cap 121 to be easily removed from the ejection orifice surface 151. As shown in FIG. 6A, the second contact portion 362 may be rounded at the end portion 363. Alternatively, as shown in FIG. 6B, the second contact portion 362 may decline from the connecting portion toward the end portion. Further alternatively, as shown in FIG. 6C, the second contact portion 362 may have a larger surface roughness than the first contact portion 361 to reduce the area in contact with the ejection orifice surface 151.

Figure 10A:
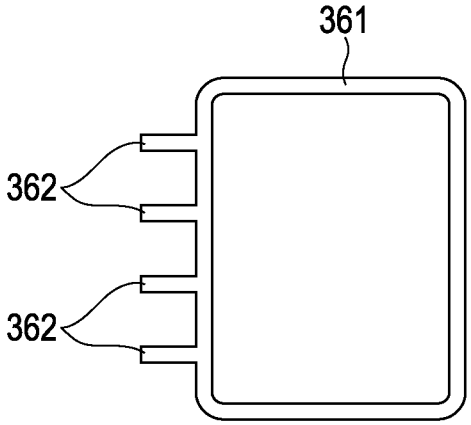
FIGS. 10A to 10D are plan views of the first contact portion and the second contact portion(s).
Figure 10B:
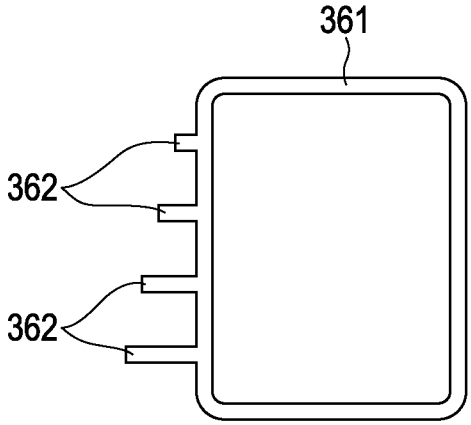
Figure 10C:
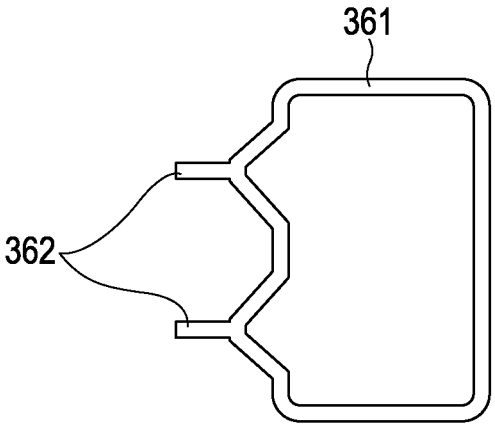
Figure 10D:
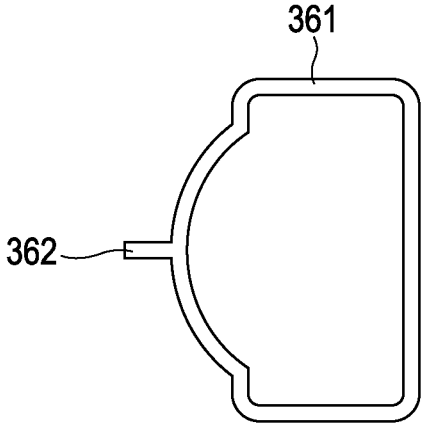

FIGS. 10A to 10D are plan views of the first contact portion and the second contact portion(s). As shown in FIG. 10A, a plurality of second contact portion 362 that extend parallel to the moving direction of the carriage 101 may be provided on the outer surface of the first contact portion 361. As shown in FIG. 10B, the second contact portions 362 may have different lengths. Alternatively, as shown in FIG. 10C, the first contact portion 361 may have a plurality of chevron-shaped portions. Alternatively, as shown in FIG. 10D, the first contact portion 361 may have an arch-shaped portion.

Figure 11A:
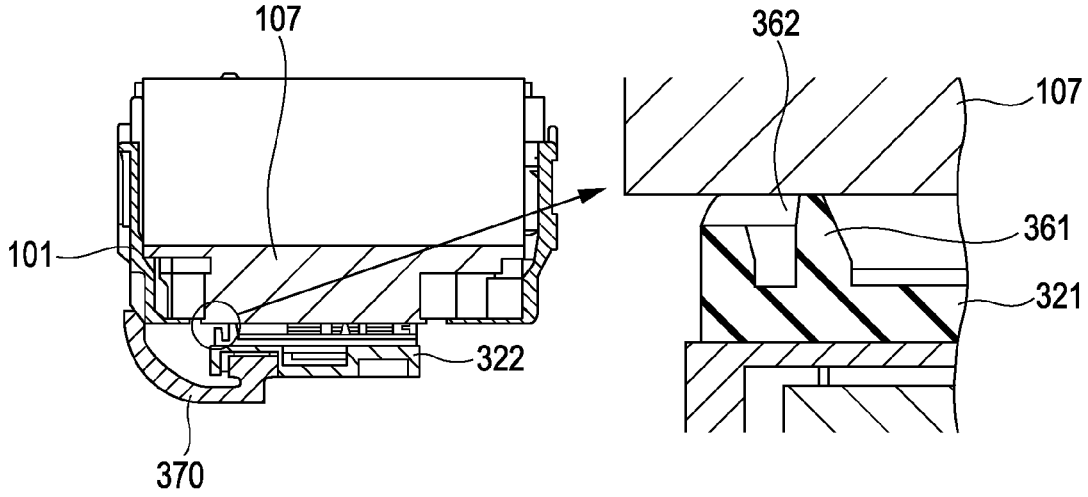
FIGS. 11A and 11B are front views showing removal of a cap with movement of a carriage, according to the third embodiment.
Figure 11B:
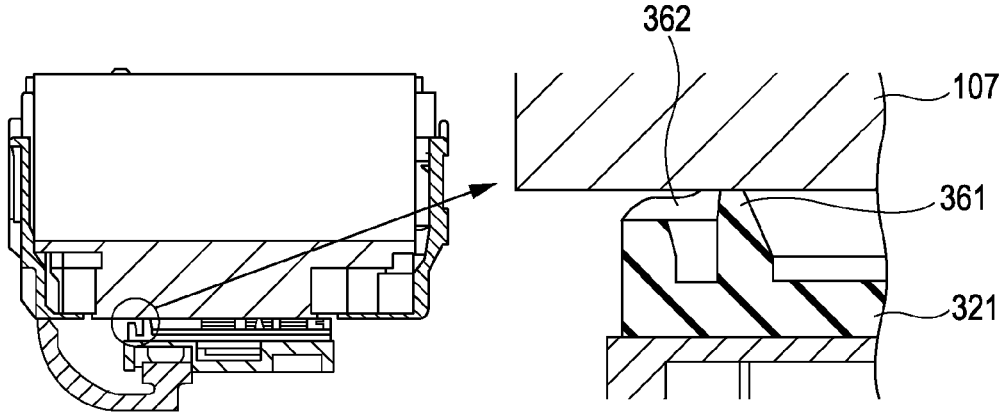

FIGS. 11A and 11B are front views showing removal of a cap with movement of a carriage, according to the third embodiment, wherein FIG. 11A shows a capped state in which the cap 321 is in contact with the ejection orifice surface 151 of the recording head 107, and FIG. 11B shows a state in which the cap 321 has been removed from the ejection orifice surface 151 with movement of the carriage 101. A cap removing lever 370 is connected to a cap holder 322. When the carriage 101 carrying the recording head 107 is moved leftward from the position shown in FIG. 11A, the carriage 101 comes into contact with the cap removing lever 370 and pushes it downward. This moves the cap holder 322 downward, whereby the cap 321 begins to be separated from the ejection orifice surface 151 from the second contact portion 362 side.

According to the third embodiment, movement of the carriage 101 carrying the recording head 107 from the capped position causes the cap 321 to be removed from the ejection orifice surface 151. Accordingly, the cap 321 and the ejection orifice surface 151 stuck together can be separated with a small force. The disadvantages associated with sticking between the recording head 107 and the cap 321 can thus be overcome at a low cost and with a small space, providing a reliable inkjet recording apparatus.

The present invention is applicable not only to single-function recording apparatuses such as printers, facsimile machines, and copying machines, but also to recording apparatuses used in multifunction recording apparatuses and systems.

According to the embodiments of the present invention, an inkjet recording apparatus that enables a cap and a recording head stuck together to be easily separated with a small force is provided.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Application No. 2007-181724 filed Jul. 11, 2007, which is hereby incorporated by reference herein in its entirety.

What is claimed is:

1. An inkjet recording comprising:

a recording head having an ejection orifice surface provided with first ejection orifices and second ejection orifices;

a carriage configured to mount and move the recording head;

a first cap configured to be pressed against the ejection orifice surface so as to surround an area provided with the first ejection orifices;

a second cap having a first contact portion being configured to be pressed against the ejection orifice surface so as to surround an area provided with the second ejection orifices;

a cap holder having the first and second caps and configured to move the second cap to a position where the first contact portion contacts the ejection orifice surface, and to a position where the first contact portion separates from the ejection orifice surface, the cap holder being rotatable around a rotational axis, disposed in a moving direction of the carriage, as the center;

a second contact portion configured to be pressed against the ejection orifice surface on the outside of the area provided with the first or second ejection orifices, the second contact portion being linear in shape and being perpendicular to the rotational axis, one end of the second contact portion being connected to an outer surface of the first contact portion; and a moving mechanism allowing the cap holder to act on the second cap at a position close to the second contact portion such that the cap holder is rotated around the rotational axis as the center.

2. The inkjet recording apparatus according to claim 1, wherein the first and second contact portions form obtuse angles on the other side of an area sealing the ejection orifices.

3. The inkjet recording apparatus according to claim 1, wherein the second contact portion is rounded at an end portion.

4. The inkjet recording apparatus according to claim 1, wherein the second contact portion declines from the portion connected to the first contact portion toward the end portion.

5. The inkjet recording apparatus according to claim 1, wherein the second contact portion has a larger surface roughness than the first contact portion.

6. The inkjet recording apparatus according to claim 1, wherein the moving mechanism is rotatable around a rotational axis, disposed in the moving direction of the carriage, as the center.

7. The inkjet recording apparatus according to claim 1, wherein the first ejection orifices are configured to discharge black ink and the second ejection orifices are configured to discharge color ink.

* * * * *